US007797763B2

(12) United States Patent
Grau

(10) Patent No.: US 7,797,763 B2
(45) Date of Patent: Sep. 21, 2010

(54) PROTECTIVE HELMET, ESPECIALLY BICYCLE HELMET

(75) Inventor: Werner Grau, Haberskirch (DE)

(73) Assignee: Uvex Sports GmbH & Co. KG, Fürth (DE)

( * ) Notice: Subject to any disclaimer, the term of this patent is extended or adjusted under 35 U.S.C. 154(b) by 263 days.

(21) Appl. No.: 11/921,503

(22) PCT Filed: Jun. 15, 2007

(86) PCT No.: PCT/EP2007/005274

§ 371 (c)(1),
(2), (4) Date: Dec. 4, 2007

(87) PCT Pub. No.: WO2008/011936

PCT Pub. Date: Jan. 31, 2008

(65) Prior Publication Data

US 2009/0293180 A1 Dec. 3, 2009

(30) Foreign Application Priority Data

Jul. 27, 2006 (DE) ..... 10 2006 034 710

(51) Int. Cl.
*A42B 1/22* (2006.01)
*A42B 7/00* (2006.01)
*A63B 71/10* (2006.01)

(52) U.S. Cl. ..... 2/417; 2/418; 2/419; 2/421; 2/425

(58) Field of Classification Search ..... 2/410, 2/416, 417, 418, 419, 420, 421, 422, 171.7, 2/181, 181.4, 183, 425; D29/102, 103
See application file for complete search history.

(56) References Cited

U.S. PATENT DOCUMENTS

| | | | | |
|---|---|---|---|---|
| 1,199,629 | A * | 9/1916 | Stocks | 2/418 |
| 1,577,183 | A * | 3/1926 | Dowiarz | 2/183 |
| 3,020,551 | A * | 2/1962 | Austin | 2/419 |
| 3,025,525 | A * | 3/1962 | Larson | 2/419 |
| 3,041,622 | A | 7/1962 | Gurtowski | |

(Continued)

FOREIGN PATENT DOCUMENTS

DE 29821855 U1 2/1999

(Continued)

OTHER PUBLICATIONS

English Machine Translation of German Patent Publication DE 202005003114 U1, Date Translated Sep. 17, 2009, translated through website: <http://epo.worldlingo.com/wl/epo/epo.html?SEED=DE202005003114U&SEED_FORMAT=E&ACTION=Description&OPS=ops.espacenet.com&LOCALE=en_GB&T=1>.*

*Primary Examiner*—Gary L Welch
*Assistant Examiner*—Jane S Yoon
(74) *Attorney, Agent, or Firm*—Browdy and Neimark, PLLC

(57) ABSTRACT

In a protective helmet, especially a bicycle helmet, having a head band made of plastic, which is fastened to the helmet calotte and which is height adjustable for adapting to the head anatomy of the wearer, provision is made that the head band is supported on both sides of the helmet calotte so as to be pivotable and that extensions are provided that extend at both end regions of the head band approximately perpendicular to the same toward the top and interior of the helmet, which engage into holding elements that are fixed in the helmet calotte, the extensions being adjustable lengthwise relative to the holding elements.

5 Claims, 2 Drawing Sheets

U.S. PATENT DOCUMENTS

| | | | | | |
|---|---|---|---|---|---|
| 3,046,559 | A | * | 7/1962 | Cox et al. | 2/419 |
| 3,075,201 | A | | 1/1963 | Lindblom | |
| 3,092,837 | A | * | 6/1963 | Austin | 2/419 |
| 3,110,900 | A | * | 11/1963 | Crowdes, Jr. | 2/419 |
| 3,156,922 | A | | 11/1964 | Anderson | |
| 3,613,114 | A | * | 10/1971 | Hill | 2/416 |
| 3,714,668 | A | * | 2/1973 | Mirabella | 2/419 |
| 3,994,023 | A | * | 11/1976 | Aileo et al. | 2/417 |
| 4,051,555 | A | | 10/1977 | Daly | |
| 4,056,852 | A | * | 11/1977 | Greendale | 2/417 |
| 5,042,093 | A | * | 8/1991 | Legendre | 2/419 |
| 5,093,936 | A | * | 3/1992 | Copeland et al. | 2/419 |
| 5,129,108 | A | * | 7/1992 | Copeland et al. | 2/424 |
| 5,142,705 | A | * | 9/1992 | Edwards | 2/418 |
| 6,341,382 | B1 | * | 1/2002 | Ryvin et al. | 2/417 |
| 7,441,282 | B2 | * | 10/2008 | Heine et al. | 2/418 |
| 7,565,704 | B2 | * | 7/2009 | Wu | 2/418 |
| 2008/0184451 | A1 | * | 8/2008 | Lemke et al. | 2/8.2 |

FOREIGN PATENT DOCUMENTS

| | | | |
|---|---|---|---|
| DE | 202005003114 | U | 5/2005 |
| EP | 1656045 | B1 | 6/2007 |

* cited by examiner

PROTECTIVE HELMET, ESPECIALLY BICYCLE HELMET

BACKGROUND

1. Field

The invention relates to a protective helmet, especially a bicycle helmet, having a head band made of plastic, which is fastened to the helmet calotte and which is height adjustable for adapting to the head anatomy of the wearer.

2. Background

A protective helmet of this type is known from DE 298 21 855U 1.

Head bands of the type in consideration, as a rule, have a changeable circumference so as to be adaptable to the circumference of the head. From DE 298 21 855 U1 it is additionally known in the sense of an even better customization to also design the head band to be height adjustable. To accomplish such a height adjustment, a kind of key is required according to the prior art, which must be inserted into a slot of the adjusting mechanism. This brings with it the shortcoming that the key must be kept in a safe place and needs to be handy to perform an adjustment.

SUMMARY

The invention is based on the object of accomplishing the adjustment of the head band by the user in a simple manner and nonetheless create a design that can be implemented cost-effectively and that permits a secure and comfortable fit of the helmet on the wearer's head.

This object is met according to the invention in such a way that the head band is supported on both sides of the helmet calotte so as to be pivotable and that extensions ale provided that extend at both end regions of the head band approximately perpendicular to the same toward the top and interior of the helmet, which engage into holding elements that are fixed in the helmet calotte, the extensions being adjustable lengthwise relative to the holding elements.

Performing a height adjustment is accordingly possible through a simple pivoting of the holding strap, a provision preferably being made for the holding elements to have a plurality of interconnected snap-in cutouts and for the extensions to have a snap-in projection, wherein the snap-in projection is lockable under elastic widening of webs between the snap-in cutouts into different snap-in cutouts as desired for length adjustment purposes through displacement in a lengthwise direction.

A lengthwise adjustment and accordingly also height adjustment can be performed in this way without the need for a tool. At the same time a stable end-position is ensured as well.

Each holding extension is advantageously designed to be sleeve-like and the snap-in cutouts are provided in an exterior sleeve wall, and the extension with the snap-in projection engages into the interior of the sleeve. This achieves a defined guidance and enhances the stability in the end position. The holding extensions are advantageously anchored by means of barbs in a foam lining of the protective helmet.

The head band may be provided with a roughened one-piece surface that acts as a Velcro-fastener mating surface for attaching pad inserts.

BRIEF DESCRIPTION OF THE DRAWINGS

The invention will be explained in more detail below based on a preferred exemplary embodiment, in conjunction with drawings, in which.

DETAILED DESCRIPTION

Figure 1:
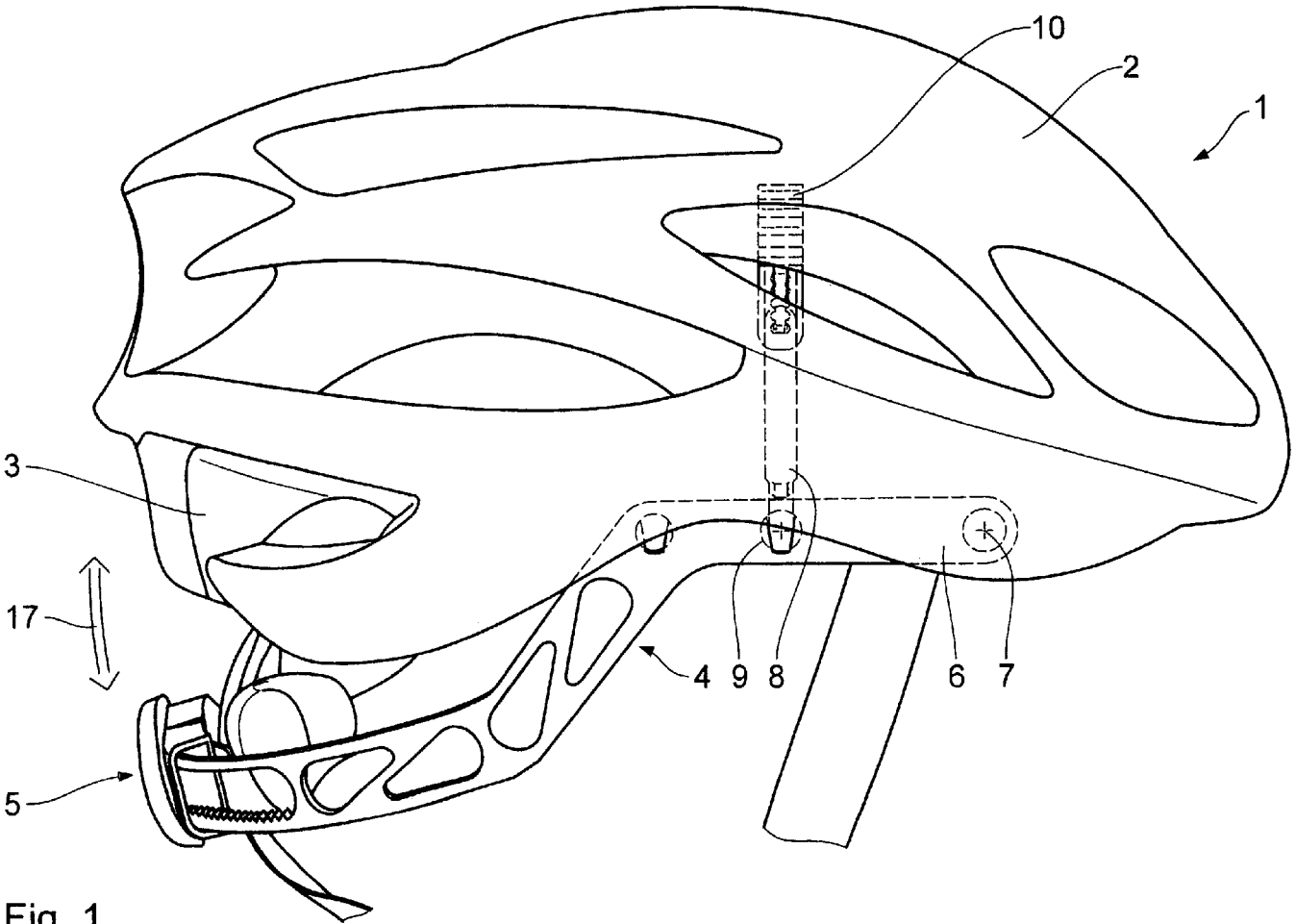
FIG. 1 shows a side view of an inventive protective helmet.
Figure 2:
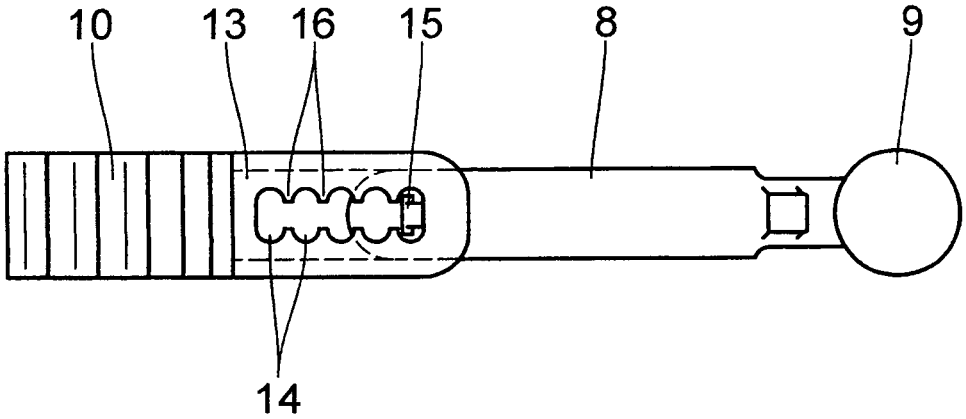
FIG. 2 shows a top view of the interlocking extensions and holding elements.
Figure 3:
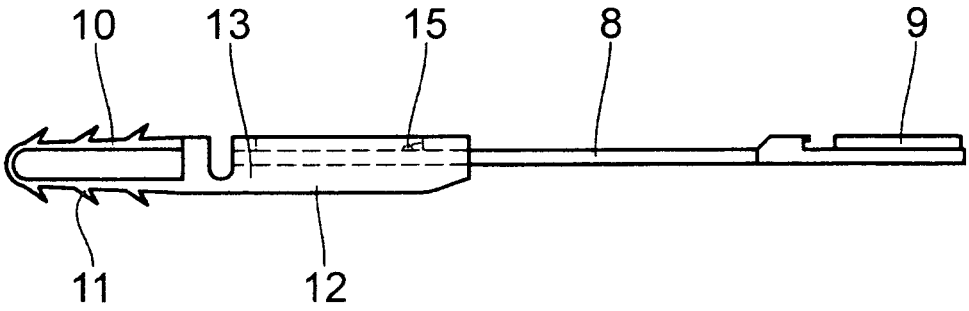
FIG. 3 shows a depiction according to FIG. 2 from a viewing angle that is shifted by 90 degrees.

A protective helmet 1 for bicyclists shown in the drawing has a smooth helmet calotte 2 made of plastic, and a foam lining 3.

A head band 4 is provided with an adjusting mechanism 5 for adjusting the circumference.

The ends 6 of the head band 4 are supported via pivot bearings 7 on the helmet calotte 2 so as to be able to pivot.

Extensions 8 in the form of plastic straps are connected to the head band 4 via a pivot bearing 9 at a certain distance from each pivot bearing 7.

Inserted into the foam lining 3 are holding elements 10, which are anchored in the foam via barbs 11. The holding elements have a sleeve-like section 12, wherein a plurality of snap-in cutouts 14 that transition into each other are formed in an exterior wall 13 of the sleeve-like section.

The extensions 8 are provided with a snap-in projection 15, which engages in each case into one of the snap-in cutouts 14 and which is repositionable through elastic widening of webs 16 between the individual snap-in cutouts 14, such that a lengthwise adjustment and, because of the pivot movement about the pivot bearing 7, a height adjustment can be accomplished, in accordance with the double arrow 17.

The invention claimed is:

1. A protective helmet, comprising:

a head band made of plastic, which is fastened to the helmet calotte and which is height adjustable for adapting to the head anatomy of the wearer, wherein the head band (4) is supported on both sides of the helmet calotte so as to be pivotable (2), extensions (8) extending at both end regions (6) of the head band (4) approximately perpendicular to the end regions (6) toward a top and interior of the helmet, holding elements (10) fixed in the helmet calotte (2), the extensions (8) engaging into the holding elements (10) and being adjustable lengthwise relative to the holding elements (10); and wherein the holding elements (10) have a plurality of interconnected snap-in cutouts (14) and the extensions (8) have a snap-in projection (15), wherein the snap-in projection (15) is lockable under elastic widening of webs (16) between the snap-in cutouts (14) into different snap-in cutouts (14) as desired for length adjustment purposes through displacement in a lengthwise direction.

2. A protective helmet according to claim 1, wherein the holding elements (10) comprise a sleeve-like extension (12) and the snap-in cutouts (14) are provided in an exterior sleeve wall (13) and wherein snap-in projection (15) engages into the interior of the sleeve-like extension(12).

3. A protective helmet according to claim 1, wherein the holding extensions (10) are anchored in a foam lining (3) of the protective helmet (1).

4. A protective helmet according to claim 1, wherein the head band (4) comprises a roughened surface that acts as a fastener mating surface for attaching pad inserts.

5. A protective helmet, comprising:

a head band made of plastic, which is fastened to the helmet calotte and which is height adjustable for adapting to the head anatomy of the wearer, wherein the head band (4) is supported on both sides of the helmet calotte so as to be pivotable (2), extensions (8) extending at both end regions (6) of the head band (4) approximately perpendicular to the end regions (6) toward a top and interior of the helmet, holding elements (10) fixed in the helmet calotte (2), the extensions (8) engaging into the holding elements (10) and being adjustable lengthwise relative to the holding elements (10); and wherein the holding elements (10) comprise a sleeve-like extension (12) and snap-in cutouts (14) provided in an exterior sleeve wall (13) and wherein the extensions (8) comprise a snap-in projection (15) that engages into the interior of the sleeve-like extension(12).

* * * * *